US009610492B1

(12) United States Patent
Moran

(10) Patent No.: US 9,610,492 B1
(45) Date of Patent: Apr. 4, 2017

(54) ADJUSTABLE CAMBER SNOW-GLIDING BOARD

(71) Applicant: John Moran, Grover Beach, CA (US)

(72) Inventor: John Moran, Grover Beach, CA (US)

( * ) Notice: Subject to any disclaimer, the term of this patent is extended or adjusted under 35 U.S.C. 154(b) by 0 days.

(21) Appl. No.: 14/705,227

(22) Filed: May 6, 2015

(51) Int. Cl.
*A63C 5/07* (2006.01)
*A63C 5/00* (2006.01)

(52) U.S. Cl.
CPC ..... *A63C 5/07* (2013.01); *A63C 5/003* (2013.01)

(58) Field of Classification Search
CPC ..... A63C 5/07; A63C 5/003; A63C 5/0405; A63C 5/00; A63C 5/04
See application file for complete search history.

(56) References Cited

U.S. PATENT DOCUMENTS 2,188,582 A * 1/1940 Serr ..... A63C 5/048 280/602
2,918,293 A * 12/1959 Tavi ..... A63C 5/07 280/602
3,747,947 A * 7/1973 Gunzel ..... A63C 5/07 280/602
4,199,169 A * 4/1980 Guenzel ..... A63C 5/07 280/602
4,300,786 A * 11/1981 Alley ..... A63C 7/005 280/602
5,769,445 A * 6/1998 Morrow ..... A63C 5/03 280/14.21
7,014,206 B2 * 3/2006 Donze ..... A63C 5/07 280/602
7,296,818 B2 * 11/2007 Krumbeck ..... A63C 5/075 280/11.14
7,360,782 B2 * 4/2008 Gignoux ..... A63C 7/005 280/11.14
7,942,436 B2 * 5/2011 Holzer ..... A63C 5/07 280/602
8,172,250 B2 * 5/2012 Krafft ..... A63C 5/0405 280/601
8,172,251 B2 * 5/2012 Holzer ..... A63C 5/003 280/602
8,794,658 B2 * 8/2014 Wilson ..... A63C 5/0405 280/602
9,044,664 B1 * 6/2015 Canaday ..... A63C 5/0405
9,216,343 B2 * 12/2015 Kessler ..... A63C 5/0405
9,393,481 B2 * 7/2016 Fournier ..... A63C 5/003
9,511,273 B2 * 12/2016 Yi ..... A63C 5/03
2011/0233900 A1 * 9/2011 Huard ..... A63C 5/0405 280/602

* cited by examiner

*Primary Examiner* — James M Dolak
(74) *Attorney, Agent, or Firm* — R. Scott Kimsey, Esq.; Klein DeNatale Goldner

(57) ABSTRACT

A snow-gliding board with adjustable camber includes a mobile actuator attached to a first portion of the board and an adjustment mechanism attached to a second portion of the board. The adjustment mechanism and mobile actuator are engaged, and travel of the mobile actuator with respect to the adjustment mechanism causes a change in camber of the snow-gliding board.

5 Claims, 11 Drawing Sheets

ADJUSTABLE CAMBER SNOW-GLIDING BOARD

RELATED APPLICATIONS

Not Applicable.

BACKGROUND AND FIELD

1. Field

A snow-gliding board, such as a snowboard or snow ski, for gliding over the surface of the snow, and more specifically a snow-gliding board having an adjustable camber.

2. Background

Various snow-gliding boards, such as snowboards and snow skis, are known in the art. An important consideration in the purchase of such a board is the side profile of the board. Users of a snow-gliding board may prefer a given side profile, or may utilize multiple boards, each having a different side profile, depending on the conditions in which the board will be used, or the desires of the user. The most common types of side profile available in a snow-gliding board include the traditional camber profile, the flat profile, the rocker profile (which incorporates a reverse camber), and the mixed-camber profile. There are many other side profiles available from various manufacturers.

Utilizing a separate board for each camber a user may desire for a given circumstance is costly and requires storage and transportation of multiple boards. Further, a user on the slopes who wishes to change to a different camber board is required to change boards entirely, generally at the base of the slope where boards having different cambers are stored by the user. Changing boards during a single run, in order to use a different camber at different portions of the mountain, according to the conditions prevailing at each portion of the mountain, is impractical, as it requires transportation of the extra boards on the mountain.

SUMMARY

A snow-gliding board with adjustable camber of the present disclosure includes a mobile actuator attached to a first portion of the snow-gliding board. An adjustment mechanism is attached to a second portion of the snow-gliding board, the adjustment mechanism engaging the mobile actuator. Travel of the mobile actuator relative to the adjustment mechanism causes a change in camber of the snow-gliding board.

The snow-gliding board may include a tensile element attached to a third portion of the snow-gliding board, as well as to the mobile actuator. Movement of the mobile actuator causes an increase or decrease in the tension of the tensile element.

The snow-gliding board may include an actuator casing attached to the snow-gliding board. At least a portion of the adjustment mechanism and mobile actuator are disposed within the actuator casing and are able to move freely therein.

The adjustment mechanism of the snow-gliding board may have a threaded shaft, and the mobile actuator may have a threaded opening configured to mate with the threaded shaft. Rotation of the adjustment mechanism causes travel of the mobile actuator with respect to the adjustment mechanism.

The adjustment mechanism may include a socket for manipulation of the adjustment mechanism by a user.

The snow-gliding board may include a tensile element sheet attached to a portion of the snow-gliding board. The tensile element sheet facilitates movement of at least a portion of the tensile element within the snow-gliding board.

Another embodiment of a snow-gliding board having an adjustable camber includes a camber-adjustment mechanism having a first attached to a first portion of the snow-gliding board, and a second attachment attached to a second portion of the snow-gliding board. The first attachment and second attachment are engaged, and the distance between the first attachment and the second attachment may be adjusted by a user.

DETAILED DESCRIPTION

As used herein, the term "board" refers generally to any snow-gliding board, such as a snowboard, snow ski, or similar device affixed to a user to allow gliding travel over snow.

As used herein, the term "camber" refers to the curvature of a board with respect to a horizontal plane thereof. For convenience, the term refers herein not only to the traditional camber of a snow-gliding board, but also to the curvature of a reverse-camber or rocker profile of a snow-gliding board, as well as various composite side profiles. Camber is used to refer the curvature of any given board, some of which may include multiple changes in curvature (or, as referred to herein, camber). The term is used thusly for convenience and clarity, such that any reference to a change in camber refers to a change in some curvature of a board along a horizontal plane.

Figure 1:
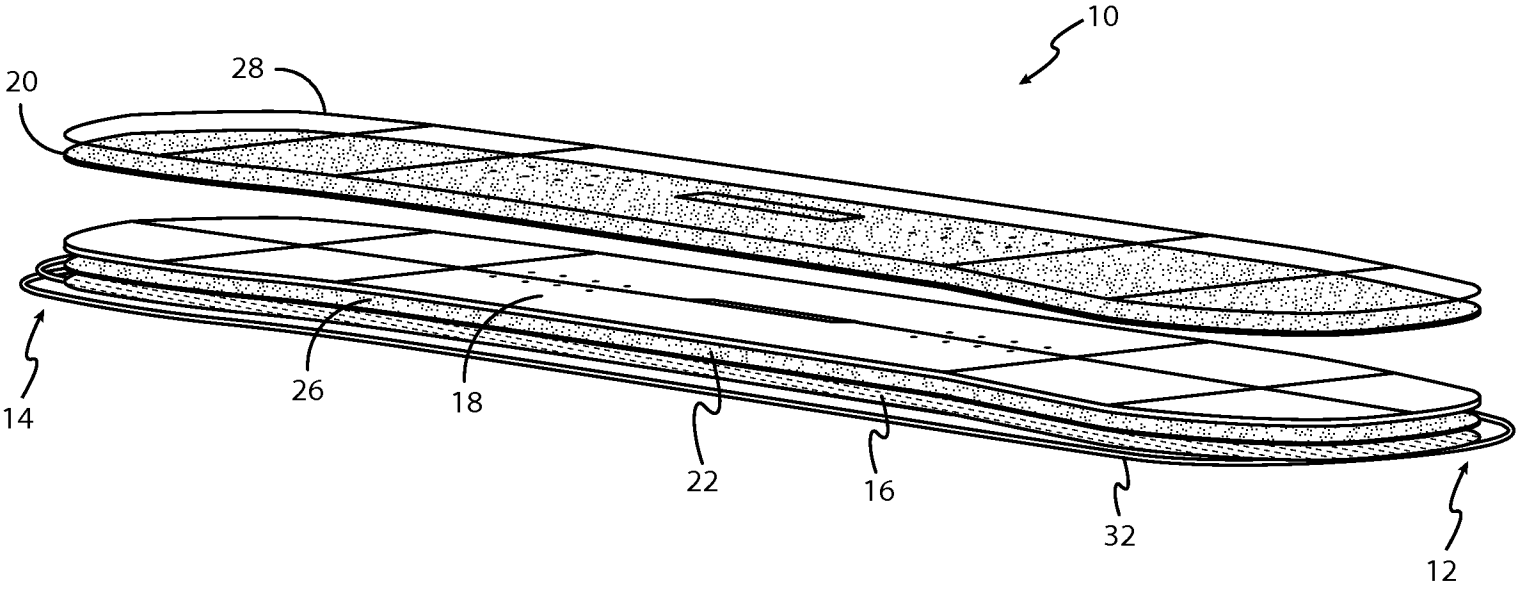
Prior Art FIG. 1
FIG. 1 is an exploded view of a snowboard known in the art.

Turning now to the drawings, wherein like numerals indicate like parts, FIG. 1 depicts a type of board, specifically a snowboard 10, suitable for use in conjunction with the principles disclosed herein. Snowboard 10 includes, generally, a nose 12, tail 14, base 16, and upper sheet 28. Snowboard 10 is shown in an exploded diagram to illustrate these and other components thereof.

Snowboards, such as snowboard 10, include a number of components common in the art. Upper sheet 28 is typically constructed of a synthetic polymer, such as, for example, polyethylene, that runs the length of snowboard 10. Beneath upper sheet 28 is an upper composite 20, also running the length of snowboard 10, which is typically constructed of fiberglass, carbon fiber, or similar materials. Below upper composite is core 18, typically constructed from wood such as poplar, a suitable foam, or a honeycomb composite. Various other suitable materials are used in the art, and it is contemplated that any suitable material may be used for the various components of the present snow-gliding board. Beneath core 18, a lower composite 22, also constructed of fiberglass, carbon fiber, or similar material, is provided. Base 16 is constructed of ultra-high molecular weight polyethylene or other suitable material. A sidewall 26 extends around the perimeter of the device, and is typically constructed from a resin or plastic, such as acrylonitrile butadiene styrene (ABS). A first edge 32 and second edge 34 are provided on either side of the board, typically affixed to base 16. First edge 32 and second edge 34 are typically constructed of steel, and in some snow-gliding board may constitute a single edge that runs along the entire perimeter of the board. A dampening foil 36, constructed of rubber or other suitable material, may be provided and may also run along the entire perimeter of snowboard 10. It is to be understood that the parts of snowboard 10 shown in FIG. 1 and described above are exemplary of snowboards found in the art, and that variations on the above, both in terms of parts and materials, may be found in existing snowboards. Snowboards having variations on the above are contemplated to be suitable for use with the camber-adjustment mechanism of the present disclosure.

Figure 2:
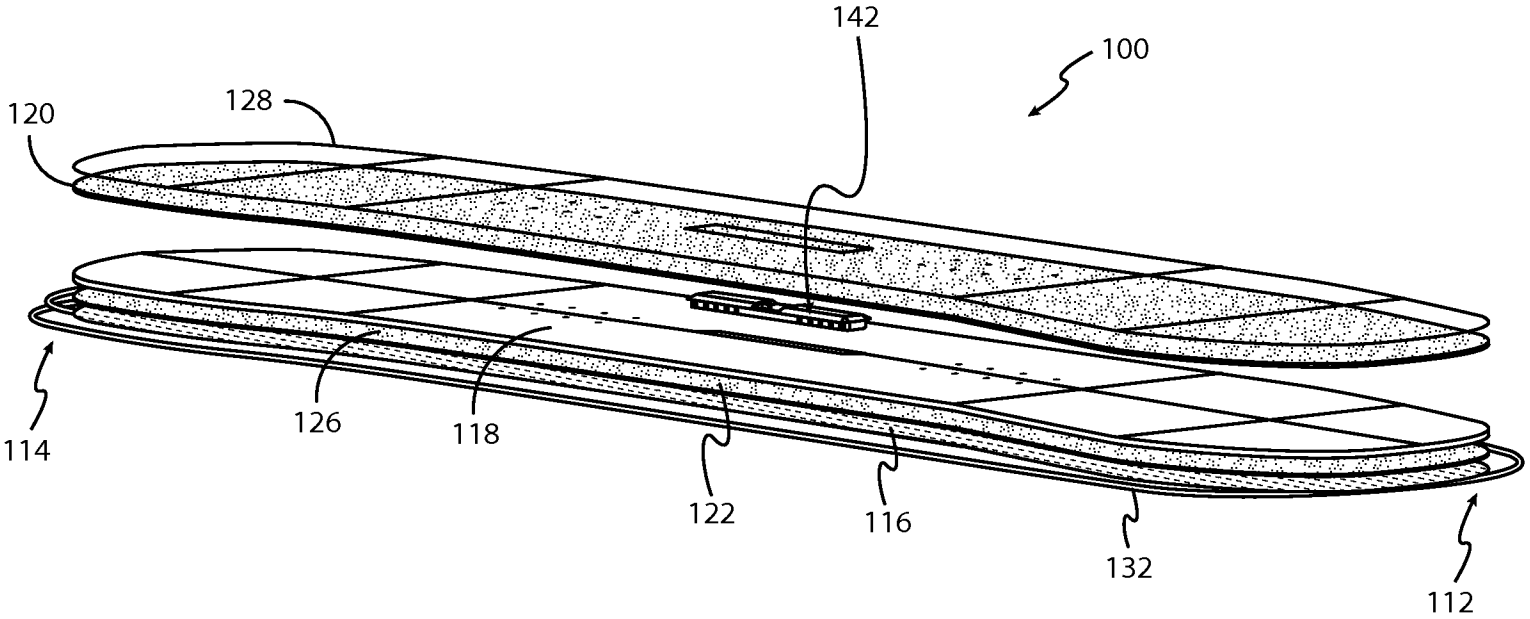
FIG. 2 is an exploded view of an exemplary embodiment of a snowboard having an adjustable camber mechanism of the present disclosure.

FIG. 2 depicts an embodiment of a snowboard 100 constructed in accordance with the principles of the present disclosure. The various components of snowboard 10 are shown here, including nose 112, tail 114, base 116, core 118, upper composite 120, lower composite 122, sidewall 126, upper sheet 128, first edge 132, and dampening foil 136. Also shown are tensile element sleeve 138, tensile element 140, adjustment mechanism 142, which components of snowboard 100 are described in greater detail, below.

Figure 3:
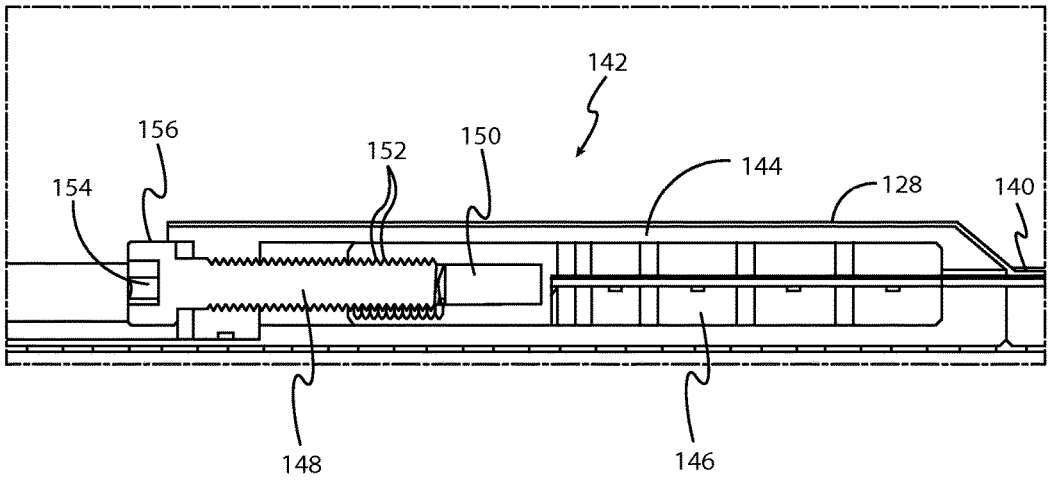
FIG. 3 is a cross-section view of an exemplary actuator assembly of the present disclosure.

FIG. 3 provides a cross-section view of an exemplary actuator assembly 142 for use with a snowboard 100. Actuator assembly 142, in the exemplary form shown, includes an actuator casing 144, which is bonded or otherwise attached to snowboard 100, a mobile actuator 146, and an adjustment mechanism 148. Mobile actuator 146 is attached to tensile element 140, which is in turn bonded to snowboard 100, allowing adjustment to the camber of snowboard 100.

The exemplary embodiment of mobile actuator 146 shown in FIG. 3 includes a threaded opening 150 at the end of mobile actuator 146 opposing that where tensile element 140 is attached. Threaded opening 150 is sized and shaped to receive an end of adjustment mechanism 148 which includes threads 152 along a portion of the length thereof, threads 152 mating with the threads of threaded opening 150. The embodiment of adjustment mechanism 148 shown in the figure also includes head 156 having a socket 154, such as the hex socket shown. A user of snowboard 100 is able to manipulate adjustment mechanism 148 using a tool that engages socket 154, thereby allowing the user to turn adjustment mechanism 148. As adjustment mechanism 148 turns, and threads 152 rotate with respect to the threads of threaded opening 150, mobile actuator 146 is either pulled toward adjustment mechanism 148 or pushed away from adjustment mechanism 148. This either increases or lessens the tension on tensile element 140, thereby resulting in a corresponding adjustment to the camber of snowboard 100. Tensile element 140 may be constructed of carbon fiber, may be a steel cable, or may be constructed in any suitable manner and of any suitable material.

Figure 4:
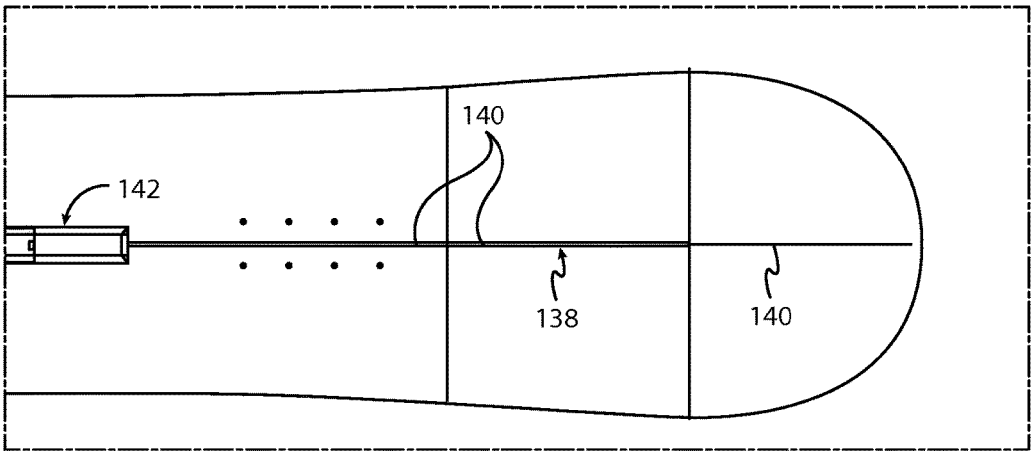
FIG. 4 is a perspective view of a portion of a snowboard through which a tensile element of the present disclosure extends.

FIG. 4 depicts a portion of snowboard 100 through which tensile element 140 extends. A first end of tensile element 140, shown in the figure as being toward the nose 112 of snowboard 100, is bonded to snowboard 100. Preferably, tensile element 140 is embedded above the core 118 and below the upper composite layer 120 of snowboard 100, and bonded to both layers. It is contemplated, however, that the tensile element may be provided in any suitable location on snowboard 100. A second portion of tensile element 140, between the bonded portion and the portion attached to mobile actuator 146, is allowed to move longitudinally within snowboard 100. It is preferred that a tensile element sleeve 138 is provided at this portion of snowboard 100, facilitating free movement of tensile element 140 within snowboard 100. Tensile element sleeve 138 may, for example, be a heat shrink sleeve that encases a portion of tensile element 140 so that tensile element 140 is able to move more freely. As tension on tensile element 140 is increased via actuator assembly 142, the degree of camber of snowboard 100 is increased. As tension on tensile element 140 is released, the degree of camber of snowboard 100 is reduced.

As shown in FIGS. 2 and 3, snowboard 100 includes a single actuator assembly 142 and tensile element 140 disposed toward the nose of snowboard 100. It is contemplated, however, that a second actuator assembly and corresponding tensile element may be provided, the second tensile element extending toward the tail 114 of snowboard 100 in the manner described with respect to actuator assembly 142 and tensile element 140, above. In such embodiments, the camber of the portion of the board between nose 112 and actuator assembly 142 may be adjusted, and the camber of the portion of the board between tail 114 and the second actuator assembly may be adjusted in concert with, or independently of, the portion of snowboard 100 near nose 112. It is further contemplated that in some embodiments of snowboard 100 a single actuator assembly may be provided, the actuator assembly engaging tensile elements extending to both the nose 112 and tail 114 of snowboard 100 so that a single assembly may be used to adjust the camber along the entire board. Alternatively, one or more smaller actuator assemblies may be provided at any desired location along the length of snowboard 100, so that the camber of any given length of snowboard 100 may be adjusted independently from the camber of any other given length of snowboard 100. For example, the camber of the middle of snowboard 100 may be adjusted, or multiple, alternating curvatures of the traditional rocker/camber style may be adjusted in terms of degree and placement of curvature.

Figure 5:
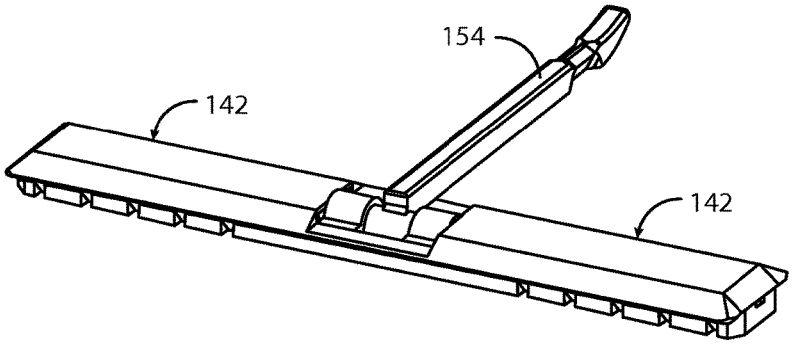
FIG. 5 is a perspective view of one embodiment of an adjustment mechanism of the present disclosure.
Figure 6A:
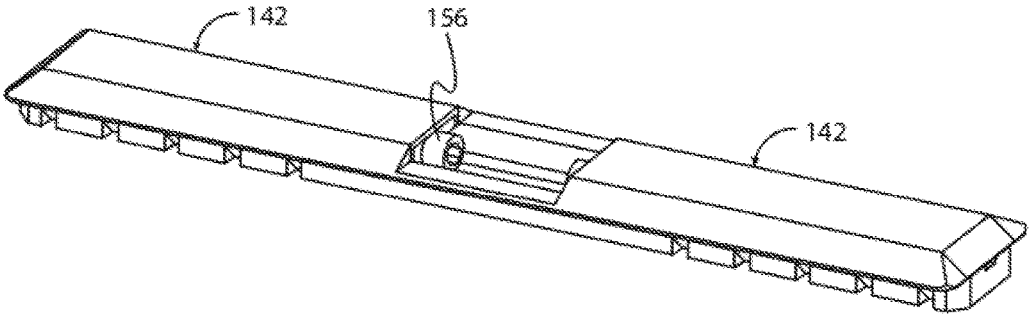
FIG. 6A is a perspective view of an embodiment of an adjustment mechanism casing having an opening for receiving a lever mechanism.
Figure 6B:
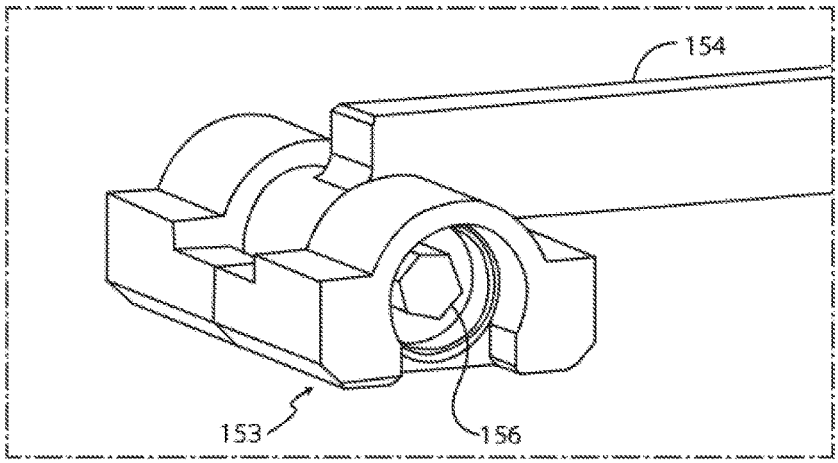
FIG. 6B is a perspective view of an embodiment of a lever mechanism for engaging an adjustment mechanism of a board of the present disclosure.

FIGS. 5, 6A, and 6B show an exemplary embodiment of a lever assembly 153 that may be used to manipulate adjustment mechanism 148. The embodiment of lever assembly 153 shown in the figures is configured for use with a snowboard 100 having actuator assemblies and associated tensile elements extending toward both the nose and tail of a snowboard. It is contemplated, however, that a similar lever system, or one modified to engage only a single actuator assembly, could be used for snowboards having only a single actuator assembly and tensile element. Lever assembly 153 includes a handle 154 attached to a set of opposing, rotatable hex keys 156. Lever assembly 153 can be inserted into actuator casing 144, into the opening between two actuator assemblies, as shown in FIG. 5. The user may then slide lever assembly 153 slightly toward the nose of snowboard 110, or slightly toward the rear of snowboard 110, depending on which actuator assembly the user wishes to engage. A hex key 156 engages one of adjustment mechanisms 148, and the user may then use lever assembly 153 to increase or reduce tension on the respective tensile element. Although a lever assembly 153 is shown in FIGS. 5, 6A, and 6B, it is to be understood that use of such an assembly is simply one exemplary way of manipulating the actuator assembly of the present device. Any suitable way of manipulating the adjustment mechanism of the actuator assembly may be employed. In some embodiments of snowboard 110, or other devices utilizing the principles disclosed herein, a gauge may be provided to display to a user the precise position of an actuator assembly, so that the user can more easily adjust the camber of snowboard 110 to a predetermined value.

Figure 7:
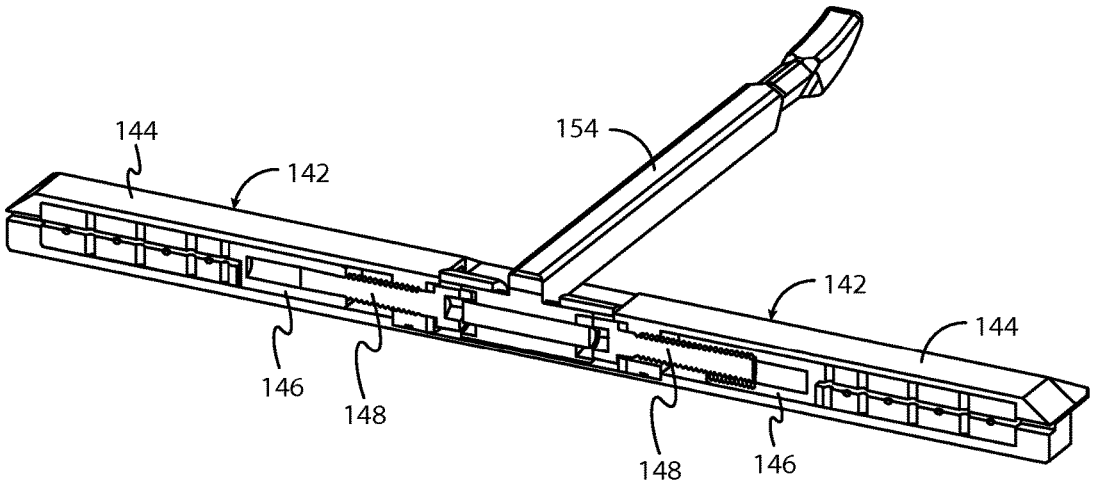
FIG. 7 is a cross-section view of a lever mechanism of the present disclosure configured to alternately engage two adjustment mechanisms for adjusting the camber of a board.

FIG. 7 is a cross-section view of a dual actuator assembly configuration that may be used in conjunction with snowboard 100 or another snow-gliding board. In the dual adjustment mechanism arrangement, two actuator assemblies 142 and 143 are provided, each having an actuator casing 144, a mobile actuator 146, and an adjustment mechanism 148. These components of the device operate as described, with the mobile actuators attached to tensile elements, a portion of which are attached to snowboard 100. A lever assembly 153, including a handle 154, is insertable into a space between the two actuator assemblies, as shown in the drawing. Thus, a user of snowboard 100 is able to adjust the camber of the portion of the snowboard toward nose 112, and also the portion of the snowboard toward tail 114, by simply sliding the lever assembly 153 to alternately engage actuator assembly 142 and actuator assembly 143.

Figure 8:
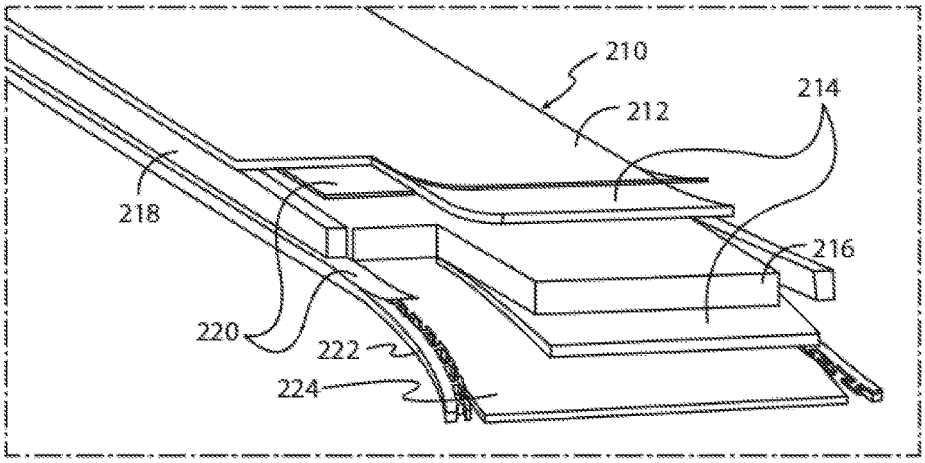
FIG. 8 (PRIOR ART)
FIG. 8 is a cross-section view of a snow ski known in the art.

FIG. 8 provides a cross-sectional view of a conventional ski 210 of the type known in the art. Ski 210 includes a topsheet 212, constructed of nylon or other suitable material. Beneath topsheet 210, a composite layer 214, made, for example, of fiberglass, carbon fiber, or other suitable material, flanks a wood core of aspen, poplar, foam, honeycomb composite, or the like. A base 224 is beneath the lower composite layer 214. Sidewalls 218 are constructed of ultra-high molecular weight polyethylene or other suitable polymer. Steel edges 222 run substantially along the length of the ski, along a lower edge thereof.

Figure 9:
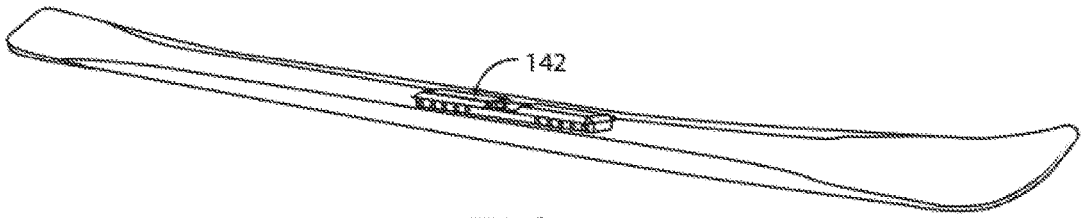
FIG. 9 is a perspective view of a snow ski including a camber adjustment mechanism of the present disclosure.

FIG. 9 is a perspective view of a ski 310 incorporating principles of the present disclosure. As shown in the figure, ski 310 includes a nose 312 and a tail 314. An adjustment mechanism 342 is shown, which is associated with tensile element 340. It is understood that in the embodiment of ski 310 shown in FIG. 9, adjustment of the camber of the ski is accomplished as described above with respect to snowboard 100. Adjustment mechanism 342 is used to increase or reduce tension on tensile element 340, thereby altering the camber of ski 310. As with snowboard 100, ski 310 may include a single tensile element, adjusting the camber of ski 310 between adjustment mechanism 342 and either the nose 312 or tail 314 of ski 310, or two tensile elements 340 may be provided so that the camber of ski 310 can be adjusted at both ends.

Figure 10:
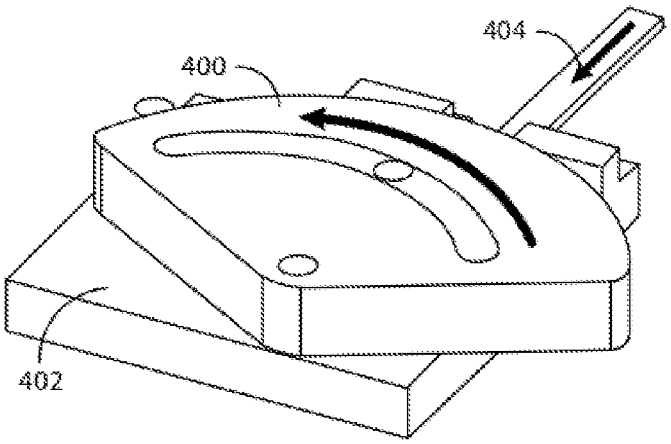
FIG. 10 is a perspective view of one alternative actuator of the present disclosure.
Figure 11:
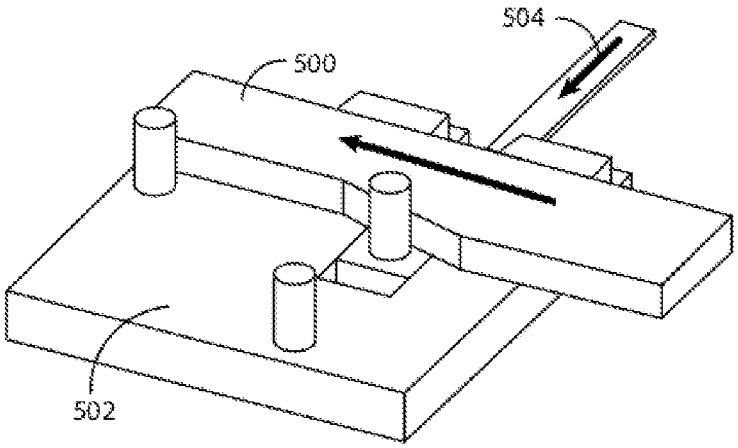
FIG. 11 is a perspective view of a second alternative actuator of the present disclosure.
Figure 12:
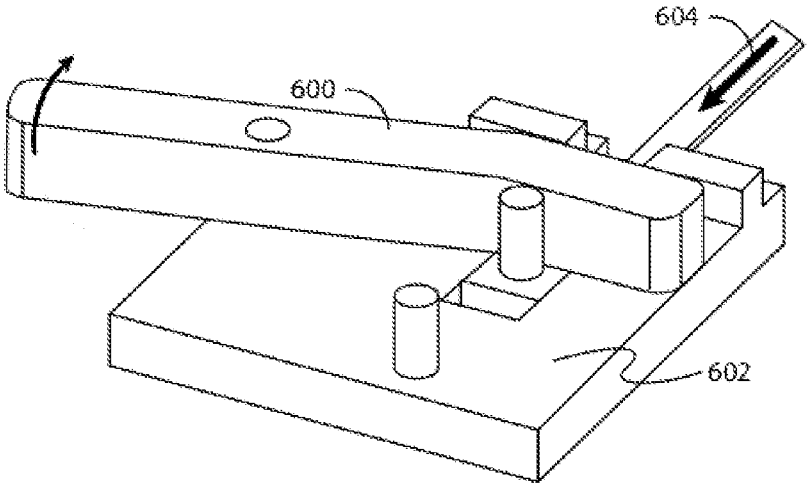
FIG. 12 is a perspective view of a third alternative actuator of the present disclosure.

FIG. 10 through 12 depict alternative adjustment mechanisms for adjusting the camber of a snow-gliding board such as a snowboard or a ski. FIG. 10 depicts a rotating cam mechanism, including a cam 400 rotatably attached to a fixed base 402. Movement of the cam causes a corresponding movement of linear actuator 404, which in turn increases or reduces the tension on a tensile element associated with the adjustment mechanism. FIG. 11 depicts a linear motion cam mechanism, which includes a linear cam 500 that moves across a fixed base 502. Movement of linear cam 500 causes a corresponding movement of linear actuator 504, which in turn increases or reduces tension on a tensile element associated with the adjustment mechanism. FIG. 12 depicts a lever mechanism, which includes a lever 600 movably attached to a fixed base 601. Movement of lever 600 causes a corresponding movement of linear actuator 604, which in turn increases or reduces tension on a tensile element associated with the adjustment mechanism.

While the description above, and the accompanying drawings, illustrate principles of the present disclosure with respect to certain embodiments of a snowboard and ski having an adjustable camber mechanism, it is contemplated that various additions, modifications, or alternatives may be utilized in construction of a snow-gliding board of the present disclosure. Exemplary modifications, additions, or alternatives are now described, with the understanding that what is described here is not exhaustive.

As shown in the figures and described above, a snowboard or ski having an adjustable camber mechanism of the present disclosure preferably uses a carbon fiber pultrusion as a tensile element. It is contemplated, however, that any suitable tensile element may be utilized. Alternative tensile elements include steel cables, fiberglass pultrusions, and the like. Tensile elements used in accordance with the principles of the present disclosure preferably have a relatively high modulus of elasticity.

In the description above, a tensile element sleeve is described, preferably in the form of a heat-shrink sleeve. The tensile element sleeve allows a portion of the tensile element to move freely within the snow-gliding board. It is contemplated, however, that some embodiments of a snow-gliding board having an adjustable camber mechanism of the present disclosure may not include a tensile element sleeve, allowing the portion of the tensile element to move within the snow-gliding board itself. Other embodiments may include alternative structures, such as enclosures or casings in which a portion of the tensile element may move. Yet other embodiments may utilized waxes or coatings along a portion of the tensile element to facilitate movement of that portion of the tensile element within the snow-gliding board.

The adjustment mechanism is shown and described as having a threaded shaft that mates with the threads in an opening of the mobile actuator. It is contemplated, however, that the adjustment mechanism and mobile actuator may engage in any suitable manner, and in some embodiments of a snow-gliding board with adjustable camber the adjustment mechanism and mobile actuator may be a single part.

As described above, a portion of the tensile element is preferably bonded within the snow-gliding board. This fixed attachment between the portion of the tensile element and the snow-gliding board allows adjustment of the camber to take place when tension is increased or reduced on the tensile element. It is contemplated, however, that instead of bonding a portion of the tensile element to the structure of the snow-gliding board, the tensile element may be mechanically attached to the board. Any suitable fastener or mechanical attachment may be used for this purpose.

As noted above, while the embodiments of a snowboard or ski shown in the figures include a single actuator mechanism associated with a single tensile element, variations in the number and placement of such elements are contemplated. For example, two or more tensile elements may be provided, extending to various portions of the snow-gliding board as desired. When more than one tensile element is present, the various tensile elements may be actuated by a single adjustment mechanism, each tensile element may have its own adjustment mechanism, or any suitable number of adjustment mechanisms may be used as desired according to the position and placement of the tensile elements.

The placement of the tensile element within the snow-gliding board may also be modified. As described above, the tensile element is embedded above the wooden core of the snow-gliding board. It is contemplated, however, that the tensile element may be embedded beneath the core of the board, and that such a placement of the tensile element may be desirable in a board having a profile opposite of that shown and described above.

In each of the embodiments shown in the drawings, adjustment of the camber of the snow-gliding board relies on tension in the tensile element, where increasing tension or 'pulling' on the tensile element causes an increase in the camber of the snow-gliding board. It is contemplated, however, that a 'push' mechanism may be used instead, wherein an adjustment mechanism imparts force on an element embedded within, or otherwise affixed to, the snow-gliding board, thereby altering the camber of the board.

Further, although a tensile element is shown in the drawings as a single structure, it is contemplated that the tensile element may be made up of multiple structures, such as individual linkages connection in a fashion so as to perform the same function as the single tensile element described above.

The embodiments of a snow-gliding board with adjustable camber described thus far have relied on internal mechanisms for adjusting the camber of the board—namely, the internal tensile element that is manipulated via the board's adjustment mechanism. It is contemplated, however, that an external mechanism may be applied to a completed snowboard or ski, one that has not been manufactured with the adjustment components described above, and that the external device could be used to adjust the camber of the board. The external mechanism may include an adjustable length or tension attached to the top of the board, and adjustment of that length, or changes in tension thereof, may be used to alter the camber of the snow-gliding board.

Figure 13:
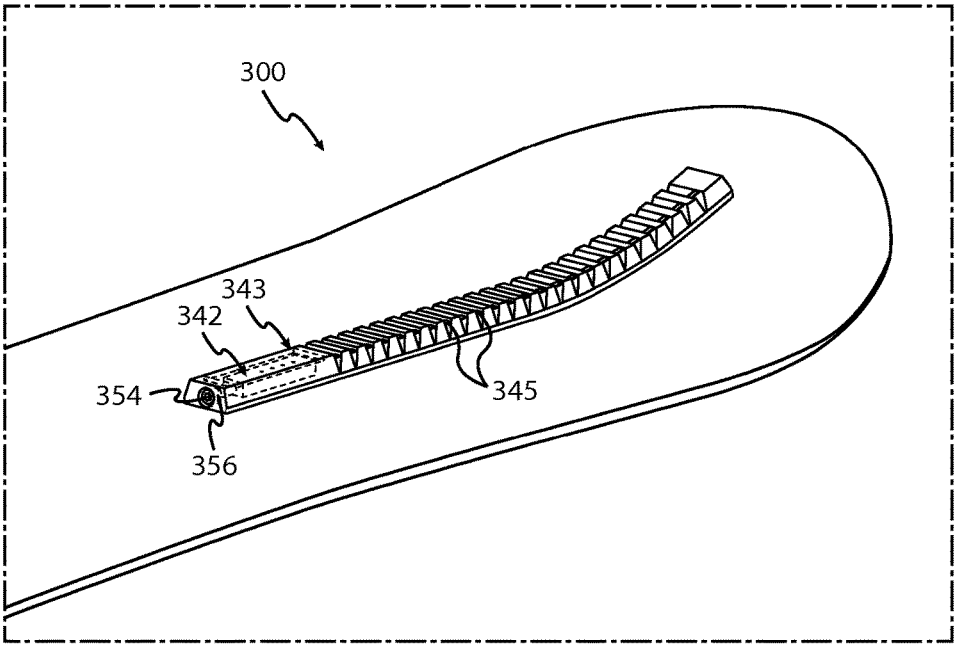
FIG. 13 is a perspective view of snowboard having an external camber-adjustment mechanism.
Figure 14:
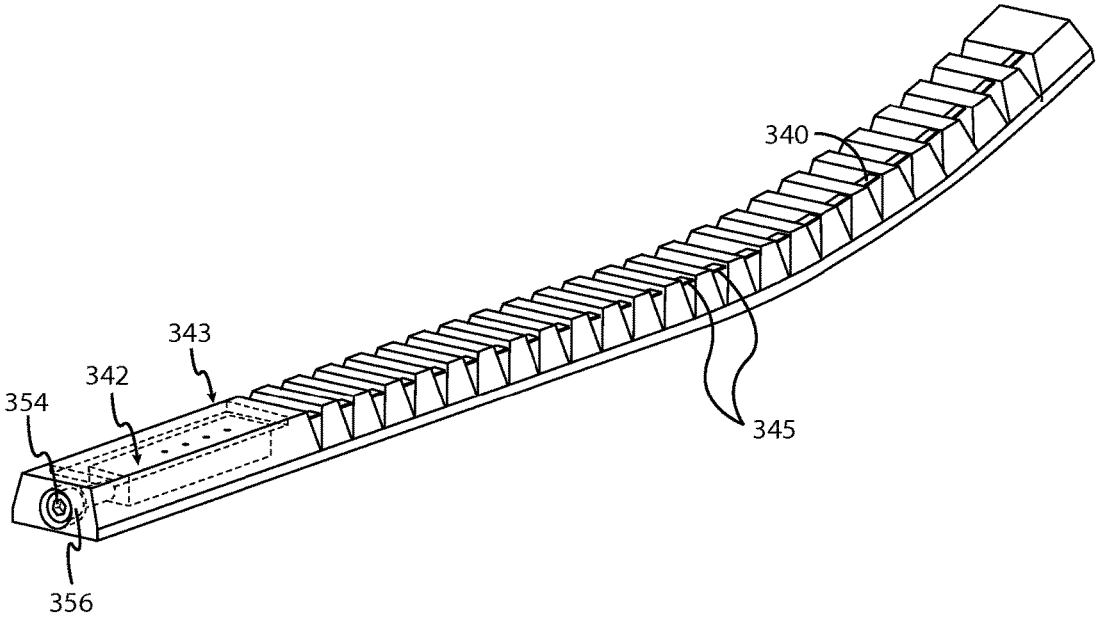
FIG. 14 is a perspective view of the external camber-adjustment mechanism of FIG. 13.

FIG. 13 provides a perspective view of a snow-gliding board 300 having one embodiment of an external camber-adjustment mechanism associated therewith. The external camber-adjustment mechanism shown in FIG. 13 shares many features of the internal adjustment mechanism described above, including an actuator assembly 342 substantially similar to that shown in FIG. 3. An adjustment mechanism having a head 356 and socket 354 allows a user to manipulate the actuator assembly 342 as described above. This manipulation increases or decreases tension on a tensile element 340, which extends away from actuator assembly 342 as shown. Because the embodiment of a camber-adjustment mechanism shown in FIG. 13 is external, a protective housing 343 is preferably provided over the various components thereof, the protective housing 343 having an opening therein through which head 356 of the adjustment mechanism may be accessed. Protective housing 343 may include numerous channels 345 formed therein to allow protective housing 343 to bend as necessary with the adjustment of the camber of snow-gliding board 300. FIG. 14 provides a perspective view of the external camber-adjustment mechanism of FIG. 13, independently of snow-gliding board 300.

An external adjustment mechanism may be attached to a snow-gliding board in any suitable manner, including by the use of adhesives or mechanical fasteners. Further, one or more external adjustment mechanisms may be used with any given snow-gliding board, and may be used to adjust the camber along the length, or any portion of the length, thereof.

Having thus described the preferred embodiment of the invention, what is claimed as new and desired to be protected by Letters Patent includes the following:

1. A snow-gliding board having a top sheet, a plurality of internal layers including: an upper composite layer beneath the top sheet and a core beneath the upper composite layer and including a neutral axis of the snow-gliding board, the improvement comprising:

an actuator assembly bonded to at least one of the plurality of internal layers of said snow-gliding board, the actuator assembly comprising:

a mobile actuator attached to a first portion of the snow-gliding board; and an adjustment mechanism engaging the mobile actuator; and a tensile element attached to a second portion of the snow-gliding board and to the mobile actuator, at least a portion of a length of said tensile element bonded to an interior structure of the snow-gliding board, wherein the tensile element is positioned above the neutral axis of the snow-gliding board and below the upper composite layer of the snow-gliding board, wherein movement of the mobile actuator relative to the adjustment mechanism causes an increase or decrease in the tension of the tensile element, thereby causing a change in camber of the snow-gliding board.

2. The snow-gliding board according to claim 1, further comprising an actuator casing attached to the snow-gliding board, at least a portion of the adjustment mechanism and the mobile actuator disposed within the actuator casing and able to move therein.

3. The snow-gliding board according to claim 2, wherein said adjustment mechanism comprises a threaded shaft, and further wherein said mobile actuator comprises a threaded opening configured to mate with said threaded shaft, wherein rotation of said adjustment mechanism causes movement of the mobile actuator with respect to said adjustment mechanism.

4. The snow-gliding board according to claim 3, wherein said adjustment mechanism comprises a socket for manipulation of the adjustment mechanism by a user.

5. The snow-gliding board according to claim 1, further comprising a tensile element sleeve attached to the snow-gliding board, the tensile element sleeve facilitating movement of at least a portion of the tensile element within the snow-gliding board.

* * * * *